US005867921A

United States Patent [19]

Maruyama et al.

[11] Patent Number: 5,867,921

[45] Date of Patent: Feb. 9, 1999

[54] FLUIDIZED BED APPARATUS FOR DRYING OR COOLING OF POWDER AND A PROCESS FOR DRYING OR COOLING POWDER WITH THE SAME

[75] Inventors: Harumasa Maruyama, Kwaguchi; Makio Matsusaka, Tokyo, both of Japan

[73] Assignee: Powdering Japan K.K., Tokyo, Japan

[21] Appl. No.: 919,619

[22] Filed: Aug. 28, 1997

Related U.S. Application Data

[63] Continuation of Ser. No. 455,535, May 31, 1995, abandoned.

[30] Foreign Application Priority Data

Nov. 21, 1994 [JP] Japan ..... 6-286504

[51] Int. Cl.[6] ..... F26B 17/00

[52] U.S. Cl. ..... 34/578; 34/360

[58] Field of Search ..... 34/360, 363, 578

[56] References Cited

U.S. PATENT DOCUMENTS

| | | | |
|---|---|---|---|
| 2,911,198 | 11/1959 | Karlsson | 34/578 |
| 3,605,276 | 9/1971 | Enders | 34/578 |
| 3,793,743 | 2/1974 | Kemmetmueller | 34/57 A |
| 3,851,406 | 12/1974 | Dumitru et al. | 34/578 |
| 3,982,901 | 9/1976 | Steer et al. | 34/578 |
| 4,130,071 | 12/1978 | Porter | 34/578 |
| 4,311,670 | 1/1982 | Nieminen et al. | 34/363 |
| 4,492,040 | 1/1985 | Jensen et al. | 34/10 |
| 5,478,544 | 12/1995 | Schütte et al. . | |

FOREIGN PATENT DOCUMENTS

| | | | |
|---|---|---|---|
| 380 331 | 5/1986 | Austria | F26B 3/08 |
| 0 379 461 | 7/1990 | European Pat. Off. | F26B 3/08 |
| 0 537 637 | 4/1993 | European Pat. Off. | F26B 3/084 |
| 1 152 928 | 2/1958 | France . | |
| 1 402 633 | 5/1965 | France . | |
| 43 16 320 | 11/1994 | Germany | C01B 15/12 |
| WO 94/14705 | 7/1994 | WIPO | C01D 7/12 |

OTHER PUBLICATIONS

European Office Action dated Apr. 29, 1994, issued in a counterpart foreign application.

European Search Report dated Mar. 12, 1996, issued in a counterpart foreign application.

*Primary Examiner*—John T. Kwon

*Attorney, Agent, or Firm*—Cushman Darby & Cushman, IP Group of Pillsbury, Madison & Sutro

[57] ABSTRACT

A fluidized bed apparatus and process for using the same for drying or cooling powder. The apparatus includes a structure defining first and second fluidizing chambers separated by an air dispersing floor plate having a plurality of openings formed therethrough. The first fluidizing chamber receives fluidizing air introduced into the structure and passes the fluidizing air through the plurality of openings in the air dispersing floor plate to disperse the fluidized air. The second fluidizing chamber containing the powder receives the fluidized air dispersed by the air dispersing floor plate. The apparatus further includes a heat transfer unit including a plurality of rectangular heat transfer metal plates disposed vertically above the air dispersing floor plate. The heat transfer metal plates are arranged in parallel relationship to and horizontally spaced from each other to define vertically-extending external passages therebetween, which allow the fluidizing air to pass therethrough and suspend the powder. The heater transfer metal plates define at least one internal passage therein associated with an inlet pipe and an outlet pipe at each end for respectively receiving and discharging a heat transfer medium. At least a portion of the internal passage extends in a horizontal direction.

8 Claims, 5 Drawing Sheets

FLUIDIZED BED APPARATUS FOR DRYING OR COOLING OF POWDER AND A PROCESS FOR DRYING OR COOLING POWDER WITH THE SAME

This is a continuation of application Ser. No. 08/455,535, filed on May 31, 1995, which was abandoned upon the filing hereof.

BACKGROUND OF THE INVENTION

1. Field of the Invention

The present invention relates to a fluidized bed equipment and a process for drying or cooling of powder by use of the equipment, which relates especially to an equipment and a process which enables with a remarkably high heat efficiency fluidized bed drying or cooling of an extremely fine powder or an extremely low density powder heretofore hardly processed under steady operating conditions with an economically feasible areal velocity due to their tendency of being entrained by the fluidizing air flow.

2. Description of the Prior Art

For conventional fluidized bed drying (cooling) equipments employing solely air as the heat transfer medium, the heat transferred per unit area of the air dispersing floor plate (grid) is determined by the difference in inlet and outlet air temperatures as well as the volume of air (areal velocity× time).

In the operation of fluidized bed equipments, the areal velocity is usually settled at a value around the maximum (the value above which no fluidized bed of powder is formed due to flying out of powder) for enhancing the cost-performance based on a larger coefficient of heat capacity to bring about a decreased floor plate area and an decreased cost of the fluidized bed equipment. However, the features and design principles bring about the following problems on conventional fluidized bed drying (cooling) equipments.

a) The larger the air dispersing floor plate areal velocity, the more the contact of powder with air becomes insufficient, which tends to cause larger differences between temperature of powder being-heated (cooled) in-the fluidized bed-and temperature of the gas passing through the bed. Though this results a large coefficient of heat capacity for the equipment, it brings about a reduced heat efficiency due to a decrease in effective air temperature differences (differences between inlet and outlet air temperatures). A thick fluidized bed is contemplated to overcome a large temperature difference between the powder and air, however, a large amount of powder must be retained in the bed and tends to cause uneven fluidization due fluctuation in bed thickness.

b) When an equipment is operated with an allowable hottest air for the highest cost-performance, degradation and scorching of retained powder tend to occur.

c) The heat efficiency is low, and a low heat efficiency of as low as less than 20% is observed especially for a low temperature fluidized bed drying of a thermally unstable powder.

d) A long period of time is necessary after the start up until reaching to stationary operating conditions.

e) A large size equipment is required for processing a large mount of material, due to a low heat efficiency.

f) The cost-performance is determined based on the coefficient of heat capacity being around 2000–6000 Kcal/$m^3$h°C. for practical equipments, and below 1000 Kcal/$m^3$h°C. is considered to be impractical commercially. From this reason, for conventional fluidized bed drying (cooling) equipments, fine powder having a air dispersing floor plate maximum areal velocity of less than 20 cm/s are recognized as out of the subject. In the above, the coefficient of heat capacity means the product of a coefficient of heat transfer and an effective heat transfer area per unit volume of equipment; the coefficient of heat transfer means the quantity of heat transferred per unit heat transfer area per unit length of time per unit temperature difference; and the heat efficiency means the ratio of quantity of heat used effectively to the total quantity of heat supplied.

An agitating-rotating-fluidization equipment having a horizontal semi-cylindrical bottom wall with numerous perforations and rotary heating discs being set in the semi-cylindrical bottom for heating and agitation is proposed, in which powder is fluidized by hot air blowing through the perforations and agitated by the rotary heating discs. Since the powder remains in thin layer on the semi-cylindrical perforated bottom wall when rotation of the discs is stopped, the blow-by of air therefrom is inevitable, and so it is required to make the discs rotate forcefully to stabilize the fluidization. Further, regarding the performance, only around a half of the surface area of heating discs effectively contributes to the heat transfer.

In another type of equipment having a group of vertical pipes in the fluidized bed, it is forced to reduce the ratio of the projected area of pipes to the area of air dispersing floor plate to be around 10% because of prevention of the hindered fluidization. Owing to the structure, the group of pipes requires a header at the bottom, which tends to be an obstacle to the fluidization. For this type of equipment, for example, in order to have a total surface area of pipes of two times of the air dispersing floor plate area, the fluidizing bed of powder must have a thickness of at least 500 mm. Structurally, the equipment is being employed only for granular particulate materials allowable to adopt a high air dispersing floor plate (grid) areal velocity, and thus the heat transfer through contact with the group of pipes is regarded as supplementary to the heat transferred by air. Though the superiority of this equipment may be recognizable, it is not evaluated by usual users as superior than ordinary fluidized bed drying (cooling) equipments employing air only as the heat transfer medium because of difficulties in the operability, washability and maintenance.

A fine powder or an ultra fine powder having a small true specific gravity is entrained well by air flow and a quite low areal velocity of air is required for obtaining a stably fluidized bed of the powder, which made such powder regarded as unsuitable for being dried or cooled with conventional fluidized bed drying or cooling equipments due to a low capacity and an inferior cost-performance coming from a large scale of the equipment.

SUMMARY OF THE INVENTION

It is an object of the present invention to provide a fluidized bed equipment and a process for drying or cooling of powder by use of the equipment, which enables with a remarkably high heat efficiency fluidized bed drying or cooling of an extremely fine powder or an extremely low density powder heretofore hardly processed under steady operating conditions with an economically feasible areal velocity due to their tendency of being entrained by the fluidizing air flow. By virtue of the present invention, problems encountered by conventional type fluidized bed drying (cooling) equipments are solved, and further a fine powder having a maximum air dispersing floor plate areal velocity of less than 20 cm/s being hardly treated by conventional type fluidized bed drying (cooling) equipments can be processed efficiently.

DESCRIPTION OF THE PREFERRED EMBODIMENTS

Figure 1:
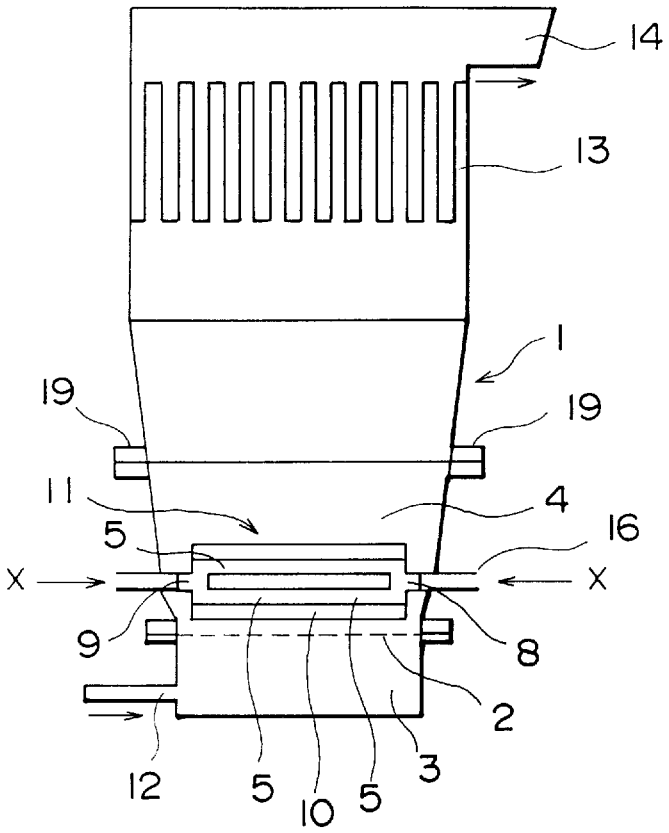
FIG. 1 is a cross-sectional side view indicating fundamental constituents of equipment of the present invention.
Figure 2:
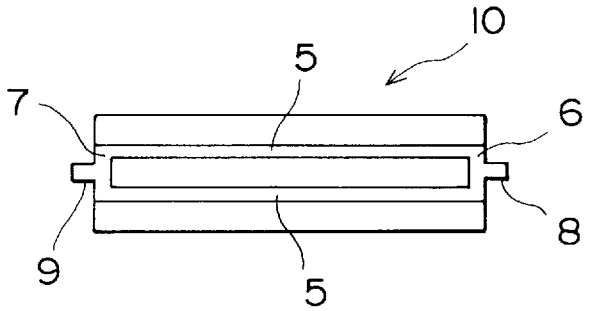
FIG. 2 is a drawing for explaining structure of a heat transfer rectangular metal plate used in the present invention.

The fluidized bed apparatus of the present invention includes a structure defining a first fluidizing chamber (also referred to as the fluidizing air chamber) and second fluidizing chamber (also referred to as the fluidizing chamber) separated by an air dispersing floor plate having a plurality of openings formed therethrough. The first fluidizing chamber receives fluidizing air introduced into the structure and passes the fluidizing air through the plurality of openings in the air dispersing floor plate to disperse the fluidized air. The second fluidizing chamber containing the powder receives the fluidized air dispersed by the air dispersing floor plate. The apparatus further includes a heat transfer unit including a plurality of rectangular heat transfer metal plates disposed vertically above the air dispersing floor plate. The heat transfer metal plates are arranged in parallel relationship to and horizontally spaced from each other to define vertically-extending external passages therebetween, which allow the fluidizing air to pass therethrough. The heater transfer metal plates define at least one internal passage therein associated with an inlet pipe and an outlet pipe at each end for respectively receiving and discharging a heat transfer medium. At least a portion of the internal passage extends in a horizontal direction.

Inherent differences between the present fluidized bed equipment and the conventional fluidized bed equipment for drying (or cooling) of powder reside in that, in the present invention, the air functions mainly as the power source for fluidizing the powder, and the heating (or cooling) of powder is conducted mainly by heat transferred in contact with the heat transfer metal plates located in the fluidized bed of powder, and a fluid flowing through inside of the passages in the heat transfer metal plates functions as the heat transfer medium. Further, another characteristic difference of the present equipment is that the designed air dispersing floor plate (grid) areal velocity is the lowest stable velocity (lowest air velocity capable of keeping a stable fluidized bed of powder) in contrast to the highest stable velocity in conventional equipments. In the present invention, the coefficient of heat capacity depends so largely on the surface area of heat transfer metal plates located in the fluidized bed that its dependence on the fluidizing air is scarce under a low air dispersing floor plate (grid) areal velocity condition. Thanks to the features, atmospheric air of not heated nor cooled may well be used for the fluidizing air under its recognition as a power source. In addition, the heat efficiency of 80–95% is far higher than that of conventional equipments. Further, the finer is the fluidizing powder, the higher becomes the heat efficiency as well as the coefficient of heat capacity in the present invention. It may be understandable therefrom that the present invention is capable of handling effectively extremely fine or extremely low density regions of powder unsuitable for conventional equipments and achieving a several times higher coefficient of heat capacity as well as a several times higher heat efficiency than conventional equipments. Moreover, the present invention can reach to stationary temperature conditions within a far shorter period of time than conventional equipments being slow in the start-up conditioning, due to employment by the former of a liquid heat transfer medium having a specific heat of 1000 times larger than air.

The characteristic structure of the present equipment will be illustrated hereunder by reference to the attached figures.

As understandable from the figures, the fluidized bed equipment comprises an air dispersing floor plate (grid) 2 having numerous small openings for dispersion of fluidizing air, a fluidizing air chamber 3 below the air dispersing floor plate (grid), a fluidizing chamber for powder 4 above the air dispersing floor plate (grid), and a heat transfer unit 11 composed of a plurality of rectangular heat transfer metal plates 10 disposed vertically and in parallel on the upper side of the air dispersing floor plate (grid) 2, said metal plate being provided internally with horizontal passage 5 having inlet pipe 8 and outlet pipe 9 for a heat transfer medium at each end.

Figure 4:
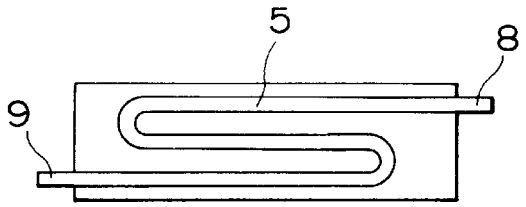
FIG. 4 is a drawing for explaining another type of a heat transfer rectangular metal plate.

The horizontal passage 5 can be a single pipe in each heat transfer metal plate 10, but it is preferable to be divided into plural horizontal passages in the heat transfer metal plate through headers 6 and 7. Further, the horizontal passage may be a single pipe which turns around even times in the heat transfer metal plate so as inlet pipe 8 and outlet pipe 9 for a heat transfer medium can locate each other at opposite ends of the heat transfer metal plate as shown in FIG. 4.

In FIG. 1, 12 denotes an air inlet pipe, 13 denotes a bag filter and 14 denotes an air outlet pipe.

Figure 5A:
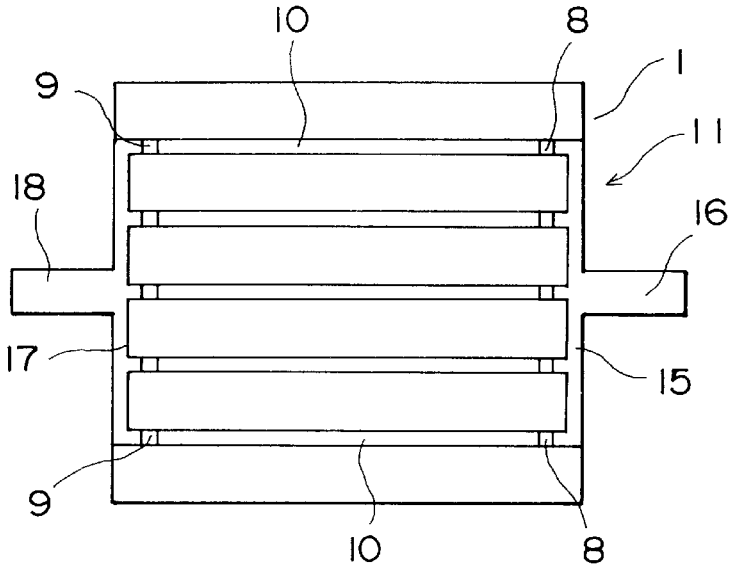
FIG. 5A is a horizontal cross-sectional view showing the structure of the heat transfer unit viewed at X—X of FIG. 1.
Figure 5B:
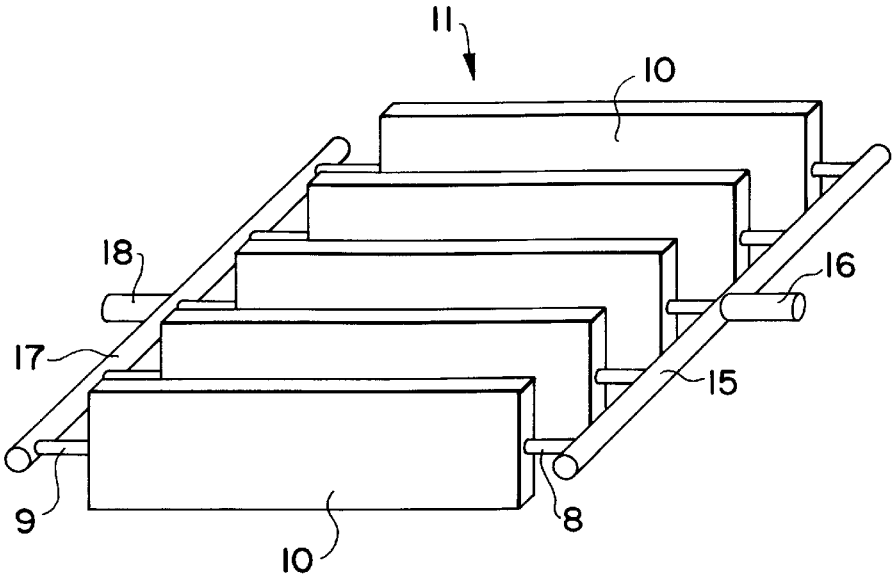
FIG. 5B is a perspective view of the heat transfer unit of FIG. 1.

In the heat transfer unit 11, the inlet pipe 8 for a heat transfer medium of the paralleled heat transfer metal plate 10 may be connected respectively to an outside source of heating or cooling medium, however, as shown in FIGS. 5A and 5B, it is preferable for simplification of the equipment that all of the inlet pipe 8 are connected to a single heat transfer medium inlet tube 16 via a header 15. Similarly, it is preferable that all of the outlet pipe 9 for a heat transfer medium are connected to a single heat transfer medium outlet tube 18 via a header 17.

In order to achieve a high coefficient of heat capacity, the total heat transfer area of the plurality of heat transfer metal plates is more than 3 times, preferably 5 times, more preferably 7 times of the area of the air dispersing floor plate (grid). For the heat transfer unit, the plurality of heat transfer metal plates are preferably disposed with an equal spacing of 20–100 mm. For maintaining stabilized fluidization state, the height of heat transfer metal plate is preferably within 1–10 times of the distance kept in the heat transfer unit by the plurality of heat transfer metal plates.

Figure 3:
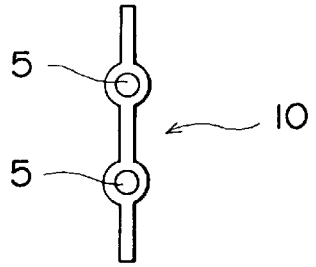
FIG. 3 is a cross-sectional view of another embodiment of a heat transfer rectangular metal plate.

The thinner the better for the thickness of heat transfer metal plate, however, a too thin thickness thereof causes problems in the strength. Thus, a thickness of 1–3 mm is preferred usually. According to an alternative embodiment, the passage of heat transfer medium 5 may expand beyond the surface of heat transfer metal plate 10 as shown in FIG. 3, however, the expanded portion is preferably not higher than 3 mm above the plate surface, as a too highly expanded portion hinders stable fluidization of powder. Materials of construction for the heat transfer metal plate are metals good in heat conductivity and processing like aluminum, and stainless steel is preferred despite its inferior heat conductivity in case of corrosion resistance is required.

Figure 8:
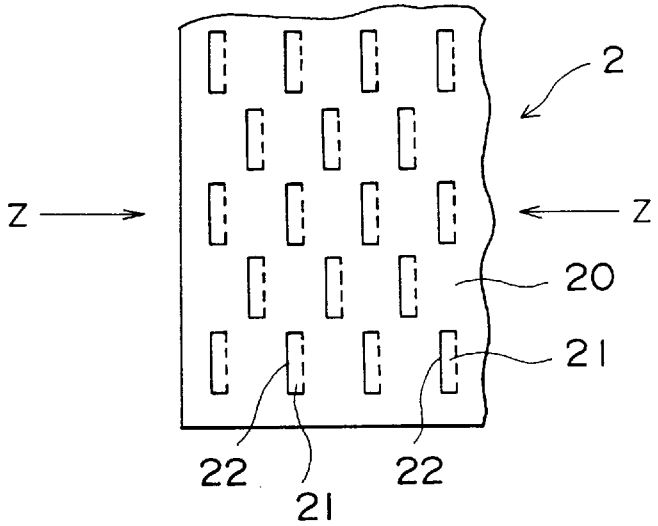
FIG. 8 is a plan view showing an air dispersing floor plate having numerous small openings.
Figure 9:
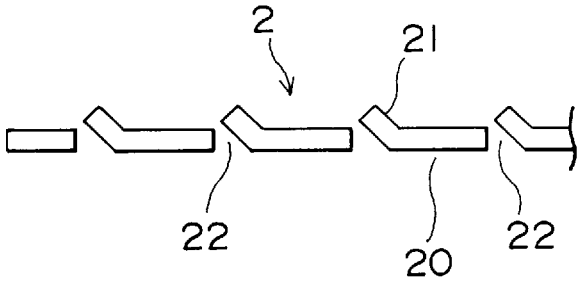
FIG. 9 is a cross-sectional view of the air dispersing floor plate in FIG. 8 viewed at Z—Z.

The structure of plate having numerous small openings to constitute the air dispersing floor plate 2 will be explained by reference to FIG. 8 showing an elevation view thereof and FIG. 9 showing a cross-sectional view thereof viewed at Z—Z. A number of [[[[ shape short nicks 21 are cut on a flat metal plate 20 having a requisite strength, and the nick is bent along the cut leaving partial connection with the metal plate 20 to form a slit 22 between the metal plate 20 and bent. Fluidizing air comes from the fluidizing air chamber 3 to the fluidizing chamber for powder 4 through the slit 22 to fluidize the powder on the air dispersing floor plate (grid) 2, (see FIG. 1). For drying or cooling with a remarkably high efficiency of an extremely fine powder or an extremely low density powder by use of the present fluidized bed equipment as especially suited for the purpose, the total opening area of slit 22 is preferably settled at not more than 1% of the area of the air dispersing floor plate (grid).

The fluidized bed equipment shown in FIG. 1 (having no powder charging pipe and powder discharging pipe) may be operated for a batch fluidized bed drying or cooling of powder by separating the equipment 1 into an upper portion and a lower portion including the fluidizing chamber for powder 4 by releasing a flange 19 connecting both portions so as charging and discharging of powder may be conducted through the released upper portion as commonly employed for the processes using conventional fluidized bed drying or cooling equipments having no heat transfer metal plates.

Figure 6:
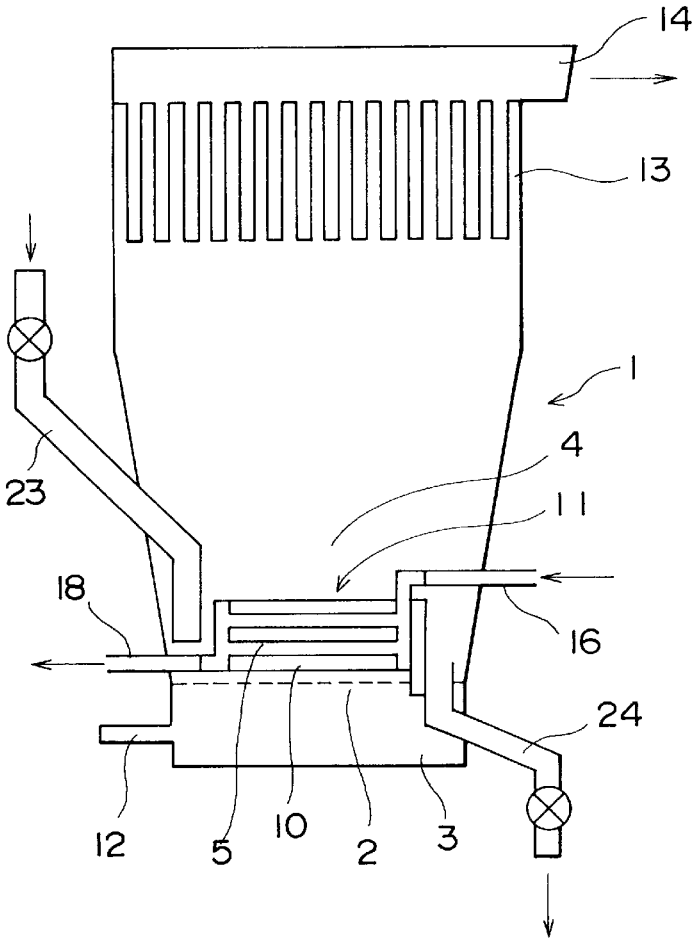
FIG. 6 is a cross-sectional side view showing another embodiment of the present invention.

However, if a powder charging pipe 23 and a powder discharging pipe 24 are disposed in the fluidizing chamber for powder as shown in FIG. 6, drying or cooling of powder can be conducted without separating the equipment into an upper portion and a lower portion each time for charging and discharging of powder.

In a batch operation of the equipment, drying and cooling can be operated successively, if the heat transfer medium inlet tube 16 is connected with a hot liquid heat transfer medium source and a cold liquid heat transfer medium source so as to be switched alternatively.

In conventional fluidized bed drying or cooling equipments, the quantity of heat transferred per unit area of air dispersing floor plate (grid) is determined by the difference between the temperature of inlet air and outlet air for the fluidized bed as well as by the quantity of air (areal velocity of air). A large quantity of heat transferred per unit area of air dispersing floor plate by means of a high areal velocity of air may be applicable to powder having a large true specific gravity and a large particle size due to its scarce flying loss, however, since a high areal velocity of air cannot be applied to powder having a small true specific gravity or a small particle size, a small quantity of heat transferred per unit area of air dispersing floor plate necessitates enlargement of the air dispersing floor plate area or prolongation of processing time to result in an inefficient equipment.

Contrary to the above in the present invention, the quantity of heat transferred by air may be small as the heat for drying or cooling of power is transferred mainly from a liquid heat transfer medium (usually warm or cold water) via the heat transfer metal plates. Under extreme cases, it is possible that air of room temperature is used for the fluidization of powder, and heating or cooling of the fluidizing air is conducted solely by means of the heat transfer metal plates. Thus, an areal velocity of fluidizing air of larger than the minimum fluidizing velocity (velocity necessary for initiating fluidization) is sufficient for carrying out efficiently the operation for powder having a small true specific gravity or a small particle size. In FIG. 1, air supplied with a specified flow rate from an outside source (not shown) is charged into the fluidizing air chamber 3 through the air inlet pipe 12, and the air is introduced into the fluidizing chamber of powder 4 after passing through the small openings of the air dispersing floor plate (grid) 2 with a specified areal velocity to fluidize the powder present in the fluidizing chamber 4. The heat transfer metal plates 10 transfer the heat supplied by the hot or cold liquid heat transfer medium to the powder for drying or cooling. Since the rate of heat transfer of the heat transfer metal plate for a system of liquid heat transfer medium/heat transfer metal plate/fluidized powder is 100 Kcal/m$^2$ΩhrΩ°C. or larger, an appropriate number of the heat transfer metal plate 10 with an appropriate height can reduce the area of the air dispersing floor plate to smaller than ⅓ of conventional equipments and enables a high heat efficiency. The most efficient operation is obtainable when the height of heat transfer metal plate 10 is selected to be around the same as the height of the fluidized bed, since the heat transfer is conducted mainly through the surface of heat transfer metal plate 10.

In a continuous operation of the present equipment for drying or cooling of powder, installation of a powder charging pipe 23 on the side of the heat transfer medium outlet tube 18 and a powder discharging pipe 24 on the side of the heat transfer medium inlet tube 16 as shown in FIG. 6 is preferred. When air is supplied to the air dispersing floor plate (grid) 2 from the fluidizing air chamber 3 and a hot or cold liquid heat transfer medium is supplied to the heat transfer medium inlet tube 16 of the heat transfer unit, the powder supplied from the powder charging pipe 23 moves forward under fluidization toward the powder discharging pipe 24 through the space formed between adjacent heat transfer metal plates while being dried or cooled countercurrently by the liquid heat transfer medium so as to be discharged from the powder discharging pipe 24. An areal velocity of air higher than the velocity initiating fluidization of powder is sufficient, and lower than 20 cm/s is preferred for powder of a small true specific gravity or a small particle size.

Figure 7:
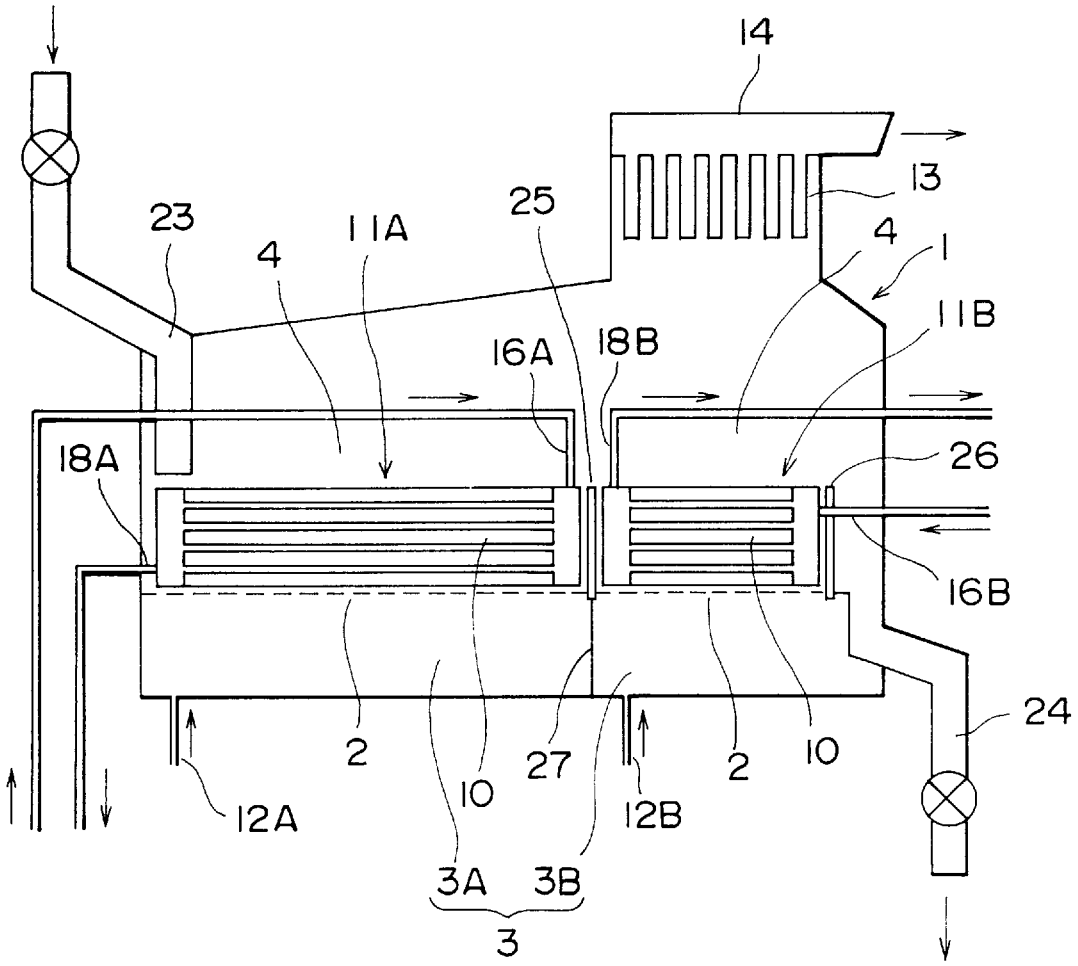
FIG. 7 is a cross-sectional side view showing another embodiment of the present invention.

FIG. 7 shows a combined fluidized bed equipment 1 for continuous drying and succeeding continuous cooling of powder.

The equipment comprises a rectangular air dispersing floor plate 2 having numerous small openings for dispersion of fluidizing air; a fluidizing air chamber 3 (3A and 3B) below the air dispersing floor plate 2; a fluidizing chamber for powder 4 above the air dispersing floor plate 2; a first heat transfer unit 11A and a second heat transfer unit 11B being placed side by side on the upper side of the air dispersing floor plate 2; and a bed height controlling vertical plate 25 between the first and the second heat transfer units 11A and 11B.

A partition plate 27 may be provided in the fluidizing air chamber 3 below the boundary between 11A and 11B so as to separate the chamber into a fluidizing air chamber 3A for a high temperature air for the first heat transfer unit and a fluidizing air chamber 3B for a low temperature air for the second heat transfer unit, if necessary.

Each heat transfer unit (11A, 11B) is composed of a plurality of rectangular heat transfer metal plates 10 disposed vertically and in parallel along the direction from the first heat transfer unit 11A to the second heat transfer unit 11B (that is, along the direction to meet at right angles with the bed height controlling vertical plate 25), and each metal plate 10 is provided internally with horizontal passage having inlet pipe and outlet pipe for a heat transfer medium at each end.

All of the inlet pipes of the plurality of rectangular heat transfer metal plates in the first heat transfer unit 11A is connected to a single heat transfer medium inlet tube 16A, and all of the outlet pipes of the plurality of rectangular heat transfer metal plates 10 in the first heat transfer unit 11A is connected to a single heat transfer medium outlet tube 18A.

The first heat transfer unit 11A is placed so as to locate the heat transfer medium outlet tube 18A at one side of the fluidizing chamber for powder 4, and a powder charging pipe 23 is provided on the side of the heat transfer medium outlet tube 18A of the first heat transfer unit 11A.

All of the inlet pipes of the plurality of rectangular heat transfer metal plates in the second heat transfer unit 11B is connected to a single heat transfer medium inlet tube 16B, and all of the outlet pipes of the plurality of rectangular heat transfer metal plates 10 in the second heat transfer unit 11B is connected to a single heat transfer medium outlet tube 18B.

The second heat transfer unit 11B is placed so as to locate the heat transfer medium inlet tube 16A at the opposite side of the fluidizing chamber for powder 4, a powder discharging pipe 24 being located on the side of the heat transfer medium inlet tube 16B of the second heat transfer unit 11B.

The combined fluidized bed equipment for continuous drying and succeeding continuous cooling of powder shown in FIG. 7 is operated by supplying air from the fluidizing air chamber 3 through the air dispersing floor plate 2 with an areal velocity of higher than the velocity of initiating fluidization of powder but not higher than 20 cm/s, supplying a hot heat transfer medium to the heat transfer medium inlet tube 16A of the first heat transfer unit 11A, supplying a cold heat transfer medium to the heat transfer medium inlet tube 16B of the second heat transfer unit 11B, supplying a humidified powder continuously from the powder charging pipe 23.

The charged powder passes through under fluidization the space formed between adjacent heat transfer metal plates of the first heat transfer unit 11A to be heated and dried by contact with the heated heat transfer metal plates and then proceeds over the bed height controlling vertical plate 25 to the second heat transfer unit 11B to pass through the space formed between adjacent heat transfer metal plates of the second heat transfer unit 11B to be cooled by contact with the cooled heat transfer metal plates so as to be discharged from the powder discharging pipe 24. Air of room temperature can be used for the fluidization of powder in the above process, however, in order to use a high temperature air for the fluidization and heating of powder in the first heat transfer unit 11A and a low temperature air for the fluidization and cooling of powder in the second heat transfer unit 11B, a partition plate 27 may be provided in the fluidizing air chamber 3 below the boundary between the heat transfer units 11A and 11B so as to separate the chamber into a fluidizing air chamber 3A for a high temperature air for the first heat transfer unit 11A and a fluidizing air chamber 3B for a low temperature air for the second heat transfer unit 11B. The air dispersing floor plate (grid) areal velocity of air may be satisfactory if higher than that for initiating fluidization, and that of lower than 20 cm/s is preferred for powder composed of powder having a small true specific gravity or a small particle size.

It is also possible to employ the present equipment for granulation and drying of wet powder.

Advantages of the present invention are as mentioned below:

a) Ultra fine or ultra low density powder can be dried or cooled with an extremely high heat efficiency, especially even a fine powder having the maximum areal air velocity of not higher than 20 cm/s which is recognized as impossible for being processed by conventional fluidized bed drying or cooling equipments can be treated efficiently.

b) The floor area required is less than a half of conventional equipments, due to the high coefficient of heat capacity.

c) The equipment cost is lower than that for conventional equipments, since conventional fluidized bed equipments using hot air for drying or dehumidified cold air for cooling are required to have a large capacity air heater, brine cooler, dehumidifier or reheater etc., in contrast to requiring not such conventional air heaters but only a small universal spot air cooler capable of cooling air to a dew point of around 15° C. for the present fluidized bed drying or cooling equipment. Thus, the construction cost becomes cheaper.

d) No deterioration nor scorching of powder occurs due to not using a large quantity of hot air, and drying of a low melting-point powder is efficiently conducted by employing warm water of a temperature lower than the melting point.

e) Stable conditions are available within a so extremely short period of time that easy operation and constant quality of dried or cooled product are available.

f) High heat efficiency and reduced operation cost are obtainable.

The present invention will be explained in detail hereunder by reference to Examples and by indicating differences in effects from Comparative Examples, however, the invention is never limited by them.

EXAMPLE 1 AND COMPARATIVE EXAMPLE 1

Fine powder having an average particle size of 25$\mu$ prepared by decomposing protein was used for comparing drying-cooling operation performances of fluidized bed equipments, in which a continuous fluidized bed drying-cooling equipment of the present invention shown in FIG. 7 was employed in Example 1 and a conventional type fluidized bed drying-cooling equipment was employed in Comparative Example 1. Items of the equipment employed, operation conditions and performance comparison are as shown below, in which [X] is "observed", [Y] is "specified" and [Z] is "calculated":

| | Present Invention | Conventional |
|---|---|---|
| POWDER PROCESSED | | |
| Powder Treated | Decomposed protein | Decomposed protein |
| Average Particle Size [X] | 25μ | 25μ |
| Specific Gravity [X] | 0.7 Kg/L | 0.7 Kg/L |
| Specific Heat [X] | 0.33 Kcal/Kg°C. | 0.33 Kcal/Kg°C. |
| Amount Charged [Y] | 200 Kg/h | 200 Kg/h |
| Amount Discharged [X] | 194 Kg/h | 194 Kg/h |
| DRYING BED | | |
| Size (width × length) [Y] | 300 mm × 1500 mm | 600 mm × 5000 mm |
| Pitch of Heat Transfer Plates [Y] | 30 mm | — |
| Height of Heat Transfer Plate [Y] | 110 mm | — |
| Surface Area of Heat Transfer Plates [Y] | 2.2 $m^2$/m | — |
| Thickness of Powder Bed (at rest) [Y] | 50 mm | 40 mm |
| Residence Amount [X] | 16 Kg | 84 Kg |
| Average Residence Time [Z] | 4.9 min | 26 min |
| Temp. of Charging Powder [X] | 70° C. | 70° C. |
| Water Content of Charging Powder [X] | 6.0% | 6.0% |
| Temp. of Charging Powder when Water was Self-evaporated [Z] | 65° C. | 65° C. |
| Self-evaporation Amount of Water [Z] | 0.6 Kg/h | 0.6 Kg/h |
| Water Content of Discharged Powder [X] | 3% | 3% |
| Water Evaporation Load [Z] | 5.4 Kg/h | 5.4 Kg/h |
| Temp. of Discharged Powder [X] | 76° C. | 76° C. |
| Temp. of Inlet Air [Y] | 80° C. | 80° C. |
| Temp. Difference, Air/Powder [X] | 0.5° C. | 1° C. |
| Floor Plate Areal Velocity [Y] | 0.1 m/sec | 0.2 m/sec |
| Temp. of Heating Medium, Inlet. [Y] | 80° C. | — |
| Temp. of Heating Medium, Outlet [X] | 78° C. | — |
| COOLING BED | | |
| Size (width × length) [Y] | 300 mm × 500 mm | 600 mm × 1100 mm |
| Pitch of Heat Transfer Plates [Y] | 30 mm | — |
| Height of Heat Transfer Plate [Y] | 80 mm | — |
| Surface Area of Heat Transfer Plates [Y] | 1.6 $m^2$/m | — |
| Thickness of Powder Bed (at rest) [Y] | 40 mm | 30 mm |
| Residence Amount [X] | 5 Kg | 14 Kg |
| Average Residence Time [Z] | 0.7 min | 4.3 min |
| Temp. of Charging powder [X] | 76° C. | 76° C. |
| Temp. of Discharged Powder [X] | 30° C. | 30° C. |
| Temp. of Inlet Air [Y] | 15° C. | 15° C. |
| Temp. Difference, Air/Powder [X] | 0.5° C. | 1° C. |
| Floor Plate Areal Velocity [Y] | 0.08 m/sec | 0.15 m/sec |
| Temp. of Heating Medium, Inlet [Y] | 20° C. | — |
| Temp. of Heating Medium, Outlet [X] | 22° C. | — |
| PERFORMANCE COMPARISON (calculation based on specified and observed values) | | |
| Area of Floor Plate, Drying Bed | 0.45 $m^2$ | 3.0 $m^2$ |
| Surface Area of Heat Transfer Plates, Drying Bed | 3.3 $m^2$ | — |
| Amount of Air, Drying Bed | 160 Kg/h | 2180 Kg/h |
| Air Heating Load, Drying Bed | 2300 Kcal/h | 31390 Kcal/h |
| Heat Transferred, Drying Bed | 300 Kcal/h | 3720 Kcal/h |
| Heat Transferring Load of Plates, Drying Bed | 3420 Kcal/h | — |

-continued

| | Present Invention | Conventional |
|---|---|---|
| Heat Transferred by Plates, Drying Bed | 3420 Kcal/h | — |
| Powder Heating Load, Drying Bed | 750 Kcal/h | 750 Kcal/h |
| Water Evaporation Load, Drying Bed | 2970 Kcal/h | 2970 Kcal/h |
| Total Heating Load, Drying Bed | 3720 Kcal/h | 3720 Kcal/h |
| Heat Efficiency, Drying Bed | 65.0% | 11.9% |
| Coeff. of Heat Cap., Drying Bed | 23300 Kcal/ $m^3$h°C. | 4400 Kcal/ $m^3$h°C. |
| Area of Floor Plate, Cooling Bed | 0.15 $m^2$ | 0.66 $m^2$ |
| Surface Area of Heat Transfer Plates, Cooling Bed | 0.8 $m^2$ | — |
| Amount of Air, Cooling Bed | 52 Kg/h | 430 Kg/h |
| Air Cooling Load, Cooling Bed | 395 Kcal/h | 3270 Kcal/h |
| Heat Transferred, Cooling Bed | 400 Kcal/h | 3130 Kcal/h |
| Heat Transferring Load of Plates, Cooling Bed | 2730 Kcal/h | — |
| Heat Transferred by Plates, Cooling Bed | 2730 Kcal/h | — |
| Powder Cooling Load, Cooling Bed | 3130 Kcal/h | 3130 Kcal/h |
| Heat Efficiency, Cooling Bed | 100.2% | 95.7% |
| Coeff. of Heat Cap, Cooling Bed | 20000 Kcal/ $m^3$h°C. | 5000 Kcal/ $m^3$h°C. |
| Environmental Conditions: 20° C./RH80% (enthalpy i = 12.2 Kcal/Kg) | | |
| Dehumidification Conditions: 20°C./RH100% (enthalpy i = 7.0 Kcal/Kg) | | |
| Dehumidification Cooling Load (12.2 − 7.0) = 5.2 Kcal/Kg | | |
| Reheating Load (10° C. to 15° C.) (15 − 10) × 0.24 = 2.4 Kcal/Kg | | |
| Cooling Air Total Processing Load = 7.6 Kcal/Kg | | |

*RH: Relative Humidity

EXAMPLE 2 AND COMPARATIVE EXAMPLE 2

Skim milk powder having an average particle size of 50 was used for comparing drying-cooling operation performances of fluidized bed equipments, in which a continuous fluidized bed drying-cooling equipment of the present invention shown in FIG. 7 was employed in Example 2 and a conventional type fluidized bed drying-cooling equipment was employed in Comparative Example 2. Items of the equipment employed, operation conditions and performance comparison are as shown below, in which [X] is "observed", [Y] is "specified" and [Z] is "calculated":

| | Present Invention | Conventional |
|---|---|---|
| POWDER PROCESSED | | |
| Powder Treated | Skim Milk Powder | Skim Milk Powder |
| Average Particle Size [X] | 50μ | 50μ |
| Specific Gravity [X] | 0.6 Kg/L | 0.6 Kg/L |
| Specific Heat [X] | 0.3 Kcal/Kg°C. | 0.3 Kcal/Kg°C. |
| Amount Charged [Y] | 1500 Kg/h | 1500 Kg/h |
| Amount Discharged [X] | 1450 Kg/h | 1450 Kg/h |
| DRYING BED | | |
| Size (width × length) [Y] | 500 mm × 3600 mm | 900 mm × 6000 mm |
| Pitch of Heat Transfer Plates [Y] | 25 mm | — |
| Height of Heat Transfer Plate [Y] | 130 mm | — |
| Surface Area of Heat Transfer Plates [Y] | 5.2 $m^2$/m | — |
| Thickness of Powder Bed (at rest) [Y] | 80 mm | 80 mm |
| Residence Amount [X] | 86 Kg | 290 Kg |
| Average Residence Time [Z] | 3.6 min | 12 min |
| Temp. of Charging Powder [X] | 70° C. | 70° C. |
| Water Content of Charging | 7.0% | 7.0% |

-continued

| | Present Invention | Conventional |
|---|---|---|
| Powder [X] | | |
| Temp. of Charging Powder when Water was Self-evaporated [Z] | 60° C. | 60° C. |
| Self-evaporation Amount of Water [Z] | 8.5 Kg/h | 8.5 Kg/h |
| Water Content of Discharged Powder [X] | 3.8% | 3.8% |
| Water Evaporation Load [Z] | 41.5 Kg/h | 41.5 Kg/h |
| Temp. of Discharged Powder [X] | 75° C. | 75° C. |
| Temp. of Inlet Air [Y] | 80° C. | 85° C. |
| Temp. Difference, Air/Powder [X] | 1° C. | 2° C. |
| Floor Plate Areal Velocity [Y] | 0.2 m/sec | 0.4 m/sec |
| Temp. of Heating Medium, Inlet [Y] | 85° C. | — |
| Temp. of Heating Medium, Outlet [X] | 81° C. | — |
| COOLING BED | | |
| Size (width × length) [Y] | 500 mm × 750 mm | 900 mm × 1850 mm |
| Pitch of Heat Transfer Plates [Y] | 25 mm | — |
| Height of Heat Transfer Plate [Y] | 130 mm | — |
| Surface Area of Heat Transfer Plates [Y] | 5.2 $m^2/m$ | — |
| Thickness of Powder Bed (at rest) [Y] | 80 mm | 80 mm |
| Residence Amount [X] | 18 Kg | 80 Kg |
| Average Residence Time [Z] | 0.7 min | 3.3 min |
| Temp. of Charging Powder [X] | 75° C. | 75° C. |
| Temp. of Discharged Powder [X] | 30° C. | 30° C. |
| Temp. of Inlet Air [Y] | 15° C. | 15° C. |
| Temp. Difference, Air/Powder [X] | 0.5° C. | 1.5° C. |
| Floor Plate Areal Velocity [Y] | 0.2 m/sec | 0.4 m/sec |
| Temp. of Heating Medium, Inlet [Y] | 18° C. | — |
| Temp. of Heating Medium, Outlet [X] | 22° C. | — |
| PERFORMANCE COMPARISON (calculation based on specified and observed values) | | |
| Area of Floor Plate, Drying Bed | 1.8 $m^2$ | 6.0 $m^2$ |
| Surface Area of Heat Transfer Plates, Drying Bed | 18.7 $m^2$ | — |
| Amount of Air, Drying Bed | 1300 Kg/h | 8800 Kg/h |
| Air Heating Load, Drying Bed | 18600 Kcal/h | 137300 Kcal/h |
| Heat Transferred, Drying Bed | 3000 Kcal/h | 30000 Kcal/h |

-continued

| | Present Invention | Conventional |
|---|---|---|
| Heat Transferring Load of Plates, Drying Bed | 27000 Kcal/h | — |
| Heat Transferred by Plates, Drying Bed | 27000 Kcal/h | — |
| Powder Heating Load, Drying Bed | 7000 Kcal/h | 7000 Kcal/h |
| Water Evaporation Load, Drying Bed | 23000 Kcal/h | 23000 Kcal/h |
| Total Heating Load, Drying Bed | 30000 Kcal/h | 30000 Kcal/h |
| Heat Efficiency, Drying Bed | 65.8% | 21.8% |
| Coeff. of heat cap., Drying Bed | 15100 Kcal/ $m^3$h°C. | 4400 Kcal/ $m^3$h°C. |
| Area of Floor Plate, Cooling Bed | 0.38 $m^2$ | 1.67 $m^2$ |
| Surface Area of Heat Transfer Plates, Cooling Bed | 3.9 $m^2$ | — |
| Amount of Air, Cooling Bed | 330 Kg/h | 2900 Kg/h |
| Air Cooling Load, Cooling Bed | 2510 Kcal/h | 22050 Kcal/h |
| Heat Transferred, Cooling Bed | 2500 Kcal/h | 21300 Kcal/h |
| Heat Transferring Load of Plates, Cooling Bed | 18800 Kcal/h | — |
| Heat Transferred by Plates, Cooling Bed | 18800 Kcal/h | — |
| Powder Cooling Load, Cooling Bed | 21300 Kcal/h | 21300 Kcal/h |
| Heat Efficiency, Cooling Bed | 99.9.% | 96.6% |
| Coeff. of Heat Cap., Cooling Bed | 26300 Kcal/ $m^3$h°C. | 5200 Kcal/ $m^3$h°C. |
| Environmental Conditions: 20° C./RH80% (enthalpy i = 12.2 Kcal/Kg) | | |
| Dehumidification Conditions: 20° C./RH100% (enthalpy i = 7.0 Kcal/Kg) | | |
| Dehumidification Cooling Load (12.2 − 7.0) = 5.2 Kcal/Kg | | |
| Reheating Load (10° C. to 15° C.) (15 − 10) × 0.24 = 2.4 Kcal/Kg | | |
| Cooling Air Total Processing Load = 7.6 Kcal/Kg | | |

EXAMPLE 3 AND COMPARATIVE EXAMPLE 3

Granulated seasoning powder having an average particle size of 900$\mu$ was used for comparing drying-cooling operation performances of fluidized bed equipments, in which a continuous fluidized bed drying-cooling equipment of the present invention shown in FIG. 7 was employed in Example 3 and a conventional type fluidized bed drying-cooling equipment was employed in Comparative Example 3. Items of the equipment employed, operation conditions and performance comparison are as shown below, in which [X] is "observed", [Y] is "specified" and [Z] is "calculated":

| | Present Invention | Conventional |
|---|---|---|
| POWDER PROCESSED | | |
| Powder Treated | Granulated Seasoning | Granulated Seasoning |
| Average Particle Size [8 X]9 | 900$\mu$ | 900$\mu$ |
| Specific Gravity [8 X]9 | 0.8 Kg/L | 0.8 Kg/L |
| Specific Heat [8 X]9 | 0.32 KCal/Kg °C. | 0.32 Kcal/Kg °C. |
| Amount Charged [Y] | 1000 Kg/h | 1000 Kg/h |
| Amount Discharged [X] | 950 Kg/h | 950 Kg/h |
| DRYING BED | | |
| Size (width × length) [Y] | 400 mm × 2150 mm | 600 mm × 3000 mm |
| Pitch of Heat Transfer Plates [Y] | 40 mm | — |
| Height of Heat Transfer Plate [Y] | 160 mm | — |
| Surface Area of Heat Transfer Plates [Y] | 3.2 $m^2/m$ | — |
| Thickness of Powder Bed (at rest) [Y] | 100 mm | 100 mm |
| Residence Amount [X] | 60 Kg | 126 Kg |

-continued

| | Present Invention | Conventional |
|---|---|---|
| Average Residence Time [Z] | 3.8 min | 8 min |
| Temp. of Charging Powder [X] | 45° C. | 45° C. |
| Water Content of Charging Powder [X] | 6.5% | 6.5% |
| Water Content of Discharged Powder [X] | 1.5% | 1.5% |
| Water Evaporation Load [Z] | 50 Kg/h | 50 Kg/h |
| Temp. of Discharged Powder [X] | 65° C. | 65° C. |
| Temp. of Inlet Air [Y] | 85° C. | 85° C. |
| Temp. Difference, Air/Powder [X] | 2° C. | 3° C. |
| Floor Plate Areal Velocity [Y] | 0.7 m/sec | 0.9 m/sec |
| Temp. of Heating Medium, Inlet [Y] | 85° C. | — |
| Temp. of Heating Medium, Outlet [X] | 82° C. | — |
| COOLING BED | | |
| Size (width × length) [Y] | 400 mm × 500 mm | 600 mm × 850 mm |
| Pitch of Heat Transfer Plates [Y] | 25 mm | — |
| Height of Heat Transfer Plates [Y] | 130 mm | — |
| Surface Area of Heat Transfer Plates [Y] | 3.2 $m^2$/m | — |
| Thickness of Powder Bed (at rest) [Y] | 100 mm | 100 mm |
| Residence Amount [X] | 14 Kg | 36 Kg |
| Average Residence Time [Z] | 0.9 min | 2.3 min |
| Temp. of Charging Powder [X] | 65° C. | 65° C. |
| Temp. of Discharged Powder [X] | 30° C. | 30° C. |
| Temp. of Inlet Air [Y] | 15° C. | 15° C. |
| Temp. Difference, Air/Powder[X] | 1° C. | 2° C. |
| Floor Plate Areal Velocity [Y] | 0.6 m/sec | 0.8 m/sec |
| Temp. of Heating Medium, Inlet [Y] | 16° C. | — |
| Temp. of Heating Medium, Outlet [X] | 20° C. | — |
| PERFORMANCE COMPARISON (calculation based on specified and observed values) | | |
| Area of Floor Plate, Drying Bed | 0.86 $m^2$ | 1.8 $m^2$ |
| Surface Area of Heat Transfer Plates, Drying Bed | 6.9 $m^2$ | — |
| Amount of Air, Drying Bed | 2170 Kg/h | 5950 Kg/h |
| Air Heating Load, Drying Bed | 31250 Kcal/h | 92800 Kcal/h |
| Heat Transferred, Drying Bed | 11200 Kcal/h | 36700 Kcal/h |
| Heat Transferring Load of Plates, Drying Bed | 25500 Kcal/h | — |
| Heat Transferred by Plates, Drying Bed | 25500 Kcal/h | — |
| Powder Heating Load, Drying Bed | 6100 Kcal/h | 6100 Kcal/h |
| Water Evaporation Load, Drying Bed | 30600 Kcal/h | 30600 Kcal/h |
| Total Heating Load, Drying Bed | 36700 Kcal/h | 36700 Kcal/h |
| Heat Efficiency, Drying Bed | 64.7% | 39.5% |
| Coeff. of Heat Cap., Drying Bed | 19300 Kcal/$m^3$h °C. | 9900 Kcal/$m^3$h °C. |
| Area of Floor Plate, Cooling Bed | 0.2 $m^2$ | 0.5 $m^2$ |
| Surface Area of Heat Transfer Plates, Cooling Bed | 1.6 $m^2$ | — |
| Amount of Air, Cooling Bed | 520 Kg/h | 1730 Kg/h |
| Air Cooling Load, Cooling Bed | 3950 Kcal/h | 13150 Kcal/h |
| Heat Transferred, Cooling Bed | 3340 Kcal/h | 10600 Kcal/h |
| Heat Transferring Load of Plates, Cooling Bed | 7260 Kcal/h | — |
| Heat Transferred by Plates, Cooling Bed | 7260 Kcal/h | — |
| Powder Cooling Load, Cooling Bed | 10600 Kcal/h | 10600 Kcal/h |
| Heat Efficiency, Cooling Bed | 94.6% | 80.6% |
| Coeff. of Heat Cap., Cooling Bed | 24900 Kcal/$m^3$h °C. | 10350 Kcal/$m^3$h °C. |

Environmental Conditions: 20° C./RH80% (enthalpy i=12.2 Kcal/Kg)

Dehumidification Conditions: 20° C./RH100% (enthalpy i=7.0 Kcal/Kg)

Dehumidification Cooling Load (12.2−7.0)=5.2 Kcal/Kg

Reheating Load (10° C. to 15° C.) (15−10)×0.24=2.4 Kcal/Kg

Cooling Air Total Processing Load=7.6 Kcal/Kg

Selected items of the Examples are mentioned below by comparison with the corresponding values taken from the Comparative Examples as 100:

| | 1. Decomposed Protein | 2. Skim Milk | 3. Granulated Seasoning |
|---|---|---|---|
| Average Particle Size | 25μ | 50μ | 900μ |
| Floor Plate Area, Ratio | | | |
| Drying Bed | 15 | 30 | 48 |
| Cooling Bed | 23 | 23 | 40 |
| Coefficient of Heat Capacity, Ratio | | | |
| Drying Bed | 530 | 340 | 190 |
| Cooling Bed | 400 | 510 | 240 |
| Heat Efficiency, Ratio | | | |
| Drying Bed | 546 | 300 | 164 |
| Cooling Bed | 105 | 103 | 117 |

As understandable from the above Examples and Comparative Examples, advantages of the present fluidized bed drying and cooling equipment over corresponding conventional equipments are exhibited more clearly when the particle size of powder to be processed becomes smaller, and the superiority is indicated more clearly especially in the floor plate area and heat efficiency in drying. In Example 2, since only a small temperature difference is allowed for drying by conventional equipments though a large difference may be available for cooling, the average particle size is nearly critical for conventional equipments. The present equipment exhibits a high performance as a secondary drying facility from the view point of a smaller floor space of air dispersing floor plate (grid) and a higher heat efficiency. In Example 3, though the large particle powder belonging to favorable ranges for conventional equipments, the present equipment exhibited superiority in a halved floor space of air dispersing floor plate and a higher heat efficiency.

What is claimed is:

1. A combined fluidized bed apparatus for continuous drying and succeeding continuous cooling of powder, said apparatus comprising:

a structure defining first and second fluidizing chambers separated by a rectangular air dispersing floor plate having a plurality of openings formed therethrough, said first fluidizing chamber constructed and arranged to receive fluidizing air introduced into said structure and pass the fluidizing air through said plurality of openings in said air dispersing floor plate to disperse the fluidized air, said second fluidizing chamber containing powder and constructed and arranged to received the fluidized air dispersed by said air dispersing floor plate;

a first heat transfer unit and a second heat transfer unit arranged adjacently and above said air dispersing floor plate, each of said heat transfer units comprising a plurality of rectangular heat transfer metal plates disposed vertically and extending along a direction from said first heat transfer unit to said second heat transfer unit;

said heat transfer metal plates arranged in parallel relationship to and spaced from each other to define vertically-extending external passages therebetween constructed and arranged to allow the fluidizing air to pass therethrough;

said heat transfer metal plates containing at least one internal passage associated with an inlet pipe and an outlet pipe at each end of said internal passage for respectively receiving and discharging a heat transfer medium;

a bed height controlling vertical plate disposed between said first and second heat transfer units;

first and second heat transfer medium inlet tubes in communication with said inlet pipes of said plurality of rectangular heat transfer metal plates of said first and second heat transfer units, respectively;

first and second heat transfer medium outlet tubes in communication with said outlet pipes of said plurality of rectangular heat transfer metal plates of said first and second heat transfer units, respectively;

said heat transfer medium outlet tube of said first heat transfer unit located in proximity to the side of said second fluidizing chamber relative to said heat transfer medium inlet pipe of said first heat transfer unit;

a powder charging pipe located on the same side of said structure as said heat transfer medium outlet tube of said first heat transfer unit;

said heat transfer medium inlet tube of said second heat transfer unit located at the opposite side of said second fluidizing chamber from said heat transfer medium outlet tube of said first heat transfer unit; and a powder discharging pipe located on the same side of said structure as said heat transfer medium inlet tube of said second heat transfer unit.

2. A combined fluidized bed apparatus according to claim 1, further comprising a partition plate for dividing said first fluidizing chamber into a chamber for accommodating said first heat transfer unit and another chamber for accommodating said second heat transfer unit.

3. A process for continuous fluidized bed drying and succeeding continuous fluidized bed cooling of powder, said process comprising the steps of:

providing an apparatus comprising:

a structure defining first and second fluidizing chambers separated by a rectangular air dispersing floor plate having a plurality of openings formed therethrough, the first fluidizing chamber constructed and arranged to receive fluidizing air introduced into the structure and pass the fluidizing air through the plurality of openings in the air dispersing floor plate to disperse the fluidized air, the second fluidizing chamber containing powder and constructed and arranged to received the fluidized air dispersed by the air dispersing floor plate;

a first heat transfer unit and a second heat transfer unit arranged adjacently and above the air dispersing floor plate, each of the heat transfer units comprising a plurality of rectangular heat transfer metal plates disposed vertically and extending along a direction from the first heat transfer unit to the second heat transfer unit;

the heat transfer metal plates arranged in parallel relationship to and spaced from each other to define vertically-extending external passages therebetween constructed and arranged to allow the fluidizing air to pass therethrough;

the heat transfer metal plates containing at least one internal passage associated with an inlet pipe and an outlet pipe at each end of the internal passage for respectively receiving and discharging a heat transfer medium;

a bed height controlling vertical plate disposed between the first and second heat transfer units;

first and second heat transfer medium inlet tubes in communication with the inlet pipes of the plurality of rectangular heat transfer metal plates of the first and second heat transfer units, respectively;

first and second heat transfer medium outlet tubes in communication with the outlet pipes of the plurality of rectangular heat transfer metal plates of the first and second heat transfer units, respectively;

the heat transfer medium outlet tube of the first heat transfer unit located in proximity to the side of the second fluidizing chamber relative to the heat transfer medium inlet pipe of the first heat transfer unit;

a powder charging pipe located proximate to the same side of the structure as the heat transfer medium outlet tube of the first heat transfer unit;

the heat transfer medium inlet tube of the second heat transfer unit located at the opposite side of the second fluidizing chamber from the heat transfer medium outlet tube of the first heat transfer unit; and a powder discharging pipe located on the same side of the structure as the heat transfer medium inlet tube of the second heat transfer unit;

supplying air from the first fluidizing chamber through the air dispersing floor plate at an areal velocity higher than the velocity for initiating fluidization of the powder but not higher than 70 cm/s;

supplying a hot heat transfer medium or a cold heat transfer medium to the heat transfer medium inlet tube;

charging a humidified powder continuously from the powder charging pipe;

heating and drying the powder in the fluidized bed existing in the first heat transfer unit; and cooling the heated and dried powder in the fluidized bed existing in the second heat transfer unit.

4. A process according to claim 3, wherein the fluidizing air is atmospheric temperature air.

5. A process according to claim 4, further comprising maintaining the second fluidizing chamber at a reduced pressure temperature and aspirating the atmospheric temperature air from the atmosphere.

6. A process according to claim 3, wherein the powder consists of particles having diameters in a range of from 25 $\mu$m to 900 $\mu$m.

7. A process according to claim 3, wherein said heating and drying step comprises exposing the powder to a gas stream having a temperature in a range of from 80° C. to 85° C.

8. A process according to claim 6, wherein said heating and drying step comprises exposing the powder to a gas stream having a temperature in a range of from 80° C. to 85° C.

* * * * *